US007336766B2

(12) United States Patent
Kitami

(10) Patent No.: US 7,336,766 B2
(45) Date of Patent: Feb. 26, 2008

(54) X-RAY SYSTEM AND ITS DRIVING METHOD

(75) Inventor: Takayuki Kitami, Otawara (JP)

(73) Assignees: Kabushiki Kaisha Toshiba, Tokyo (JP); Toshiba Electron Tubes & Devices Co., Ltd., Otawara-shi (JP)

( * ) Notice: Subject to any disclaimer, the term of this patent is extended or adjusted under 35 U.S.C. 154(b) by 0 days.

(21) Appl. No.: 10/535,676

(22) PCT Filed: Nov. 19, 2003

(86) PCT No.: PCT/JP03/14746

§ 371 (c)(1),
(2), (4) Date: Apr. 12, 2006

(87) PCT Pub. No.: WO2004/047505

PCT Pub. Date: Jun. 3, 2004

(65) Prior Publication Data

US 2006/0233306 A1 Oct. 19, 2006

(30) Foreign Application Priority Data

Nov. 19, 2002 (JP) ..... 2002-334987

(51) Int. Cl.
*H01J 35/00* (2006.01)

(52) U.S. Cl. ..... 378/131; 378/101

(58) Field of Classification Search ..... 378/91, 378/92, 101, 131, 143, 144
See application file for complete search history.

(56) References Cited

U.S. PATENT DOCUMENTS 3,963,930 A * 6/1976 Fiocca et al. ..... 378/94
4,225,787 A * 9/1980 Shapiro et al. ..... 378/94
5,883,487 A * 3/1999 Rosenzweig et al. ..... 318/781

FOREIGN PATENT DOCUMENTS

JP 64-67896 3/1989
JP 5-114497 5/1993
JP 05-114497 * 5/1993
JP 5-315091 11/1993
JP 7-282991 10/1995

* cited by examiner

*Primary Examiner*—Jurie Yun
(74) *Attorney, Agent, or Firm*—Oblon, Spivak, McClelland, Maier & Neustadt, P.C.

(57) ABSTRACT

An X-ray apparatus includes a rotary anode X-ray tube, a stator coil, and a drive-power-supply device. The rotary anode X-ray tube has an anode target arranged in a vacuum envelope, a rotary body coupled to the anode target and configured to rotate together with the anode target, and a fixed shaft supporting the rotary body, allowing the same to rotate. The stator coil generates a rotating magnetic field for rotating the rotary body of the rotary anode X-ray tube. The drive-power-supply device controls drive power to be supplied to the stator coil. The apparatus further includes a memory unit that stores a plurality of drive conditions for controlling the drive power to be supplied to the stator coil, and a control unit that selects one drive condition from the plurality of drive conditions and causes the drive-power-supply device to output drive power that matches said one drive condition.

2 Claims, 2 Drawing Sheets

X-RAY SYSTEM AND ITS DRIVING METHOD

TECHNICAL FIELD

The present invention relates to an X-ray apparatus for use in medical diagnostic apparatus or the like also to a method of driving the X-ray apparatus.

BACKGROUND ART

An X-ray apparatus comprises an X-ray tube for emitting X rays, and the like. It is used in a medical diagnostic apparatus such as a CT scanner. It is desired that the images of objects photographed by the CT scanner be improved in quality. In order to improve the quality of images, the X-ray apparatus is desired to increase the output of an X-ray tube increased.

Various types of X-ray tubes are available for use in X-ray apparatuses. One type is a rotary anode X-ray tube in which the anode target rotates. The rotary anode X-ray tube has a rotor that rotates by virtue of the rotating magnetic field generated by the stator coil that is arranged outside the tube. Thus, the anode target, which is coupled to the rotor, is rotated. When the X-ray output is to be increased, the anode target, for example, is rotated at high speed in order to avoid local heating of the anode target due to electron bombardment.

In recent years, the anode target is rotated at higher speeds in the rotary anode X-ray tube in order to increase the X-ray output of the X-ray tube.

To rotate the anode target at such high speed, the stator coil that imparts a rotation torque to the anode target, for example, is necessitated to be modified in specifications. The stator coil thus modified differs in the frequency and voltage of the drive power externally supplied to it. Hence, the drive-power-supply device that supplies the drive power to the stator coil is modified in specifications, in compliance with the modification of the stator coil. The X-ray tubes available on the market may be used, without being modified at all. In this case, the drive-power-supply device hitherto used is used without being modified.

As described above, the conventional X-ray apparatus has a drive-power-supply device that is selected in accordance with the type of the X-ray tube. Therefore, a variety of drive-power-supply devices must be provided. Hence, it is difficult to unify the specifications, as a result causing an increase of manufacturing cost.

A drive-power-supply device that can be used for the X-ray tube having a three-phase anode-rotating mechanism or a two-phase anode-rotating mechanism is known, as is disclosed in, for example, Jpn. Pat. Laid-Open Publication No. 2000-150193.

The conventional X-ray apparatuses differ in the structure and rotation speed of the rotating component, such as rotor. Inevitably, different drive-power-supply devices are used in different types of X-ray tubes. The drive-power-supply devices can hardly unified in specifications. This causes an increase of manufacturing cost.

An object of the present invention is to solve the problems described above, thereby to provide an X-ray apparatus in which a drive power fits for the stator coil can be supplied, regardless of the type of the X-ray tube, and a method of driving the X-ray apparatus.

DISCLOSURE OF THE INVENTION

An X-ray apparatus according to the present invention having a rotary anode X-ray tube comprising an anode target arranged in a vacuum envelope, a rotary body mechanically coupled to the anode target and configured to rotate together with the anode target, and a fixed shaft supporting the rotary body, allowing the rotary body to rotate on a bearing; a stator coil generating a rotating magnetic field for rotating the rotary body of the rotary anode X-ray tube; and a drive-power-supply device controlling drive power to be supplied to the stator coil, wherein the X-ray apparatus comprises a memory unit storing a plurality of drive conditions for controlling the drive power to be supplied to the stator coil; and a control unit selecting one of the drive conditions stored in the memory unit and causes the drive-power-supply device to output drive power that matches said one drive condition.

A method of driving an X-ray apparatus according to the present invention comprising: a first step of selecting one drive condition from a memory unit storing a plurality of drive conditions for drive power to be supplied to a stator coil that generates a rotating magnetic field; a second step of controlling a drive-power-supply device supplying drive power to the stator coil, in accordance with the one drive condition and supplying the drive power that matches the one drive condition to the stator coil; a third step of detecting power or current consumed at the stator coil after the second step is performed; a fourth step of determining whether the power or current detected in the third step falls within a predetermined range; and a fifth step of stopping supply of drive power from the drive-power-supply device to the stator coil when it is determined in the fourth step that the power or current consumed falls outside the predetermined range.

EMBODIMENTS OF THE INVENTION

Figure 1:
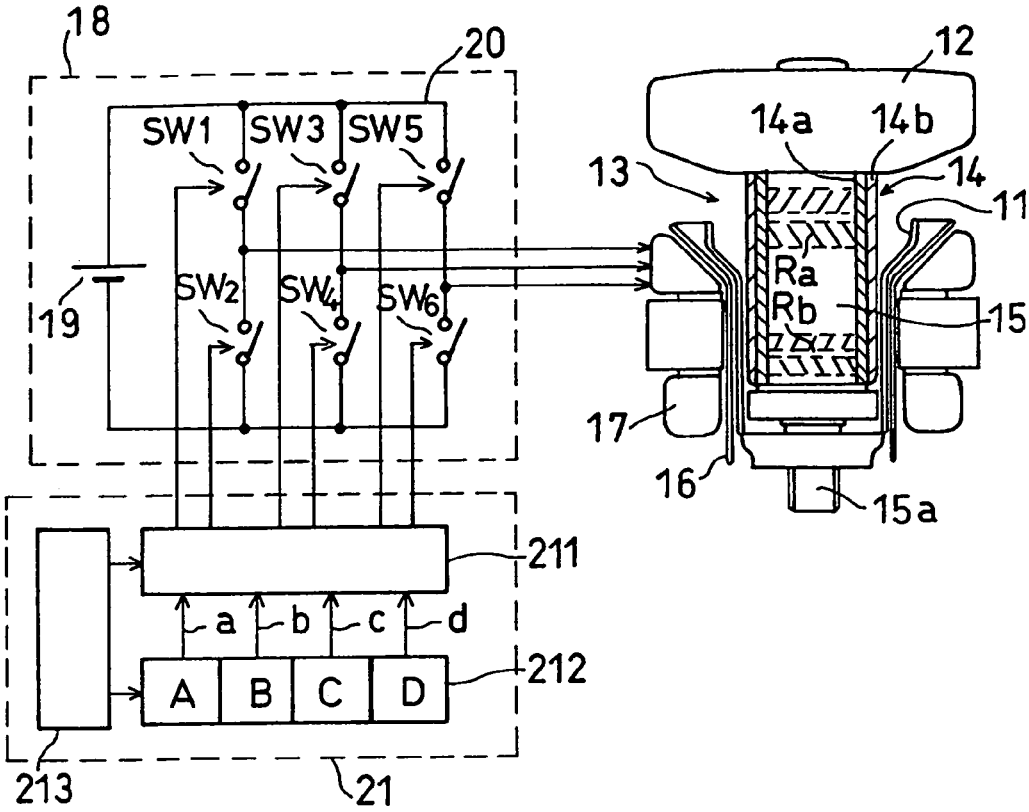
FIG. 1 is a circuit diagram for explaining an embodiment of the present invention.

An embodiment of the present invention will be described, with reference to FIG. 1. Reference numeral 11 denotes a vacuum envelope of a rotary anode X-ray tube, a part of which is shown in FIG. 1. The vacuum envelope 11 contains an anode target 12. The anode target 12 is coupled to a rotary support mechanism 13. The rotary support mechanism 13 supports the anode target 12, allowing the same to rotate. The rotary support mechanism 13 comprises a rotary body 14 and a fixed shaft 15. The anode target 12 is coupled to, for example, the rotary body 14. The fixed shaft 15 is fitted in the inner space provided in the rotary body 14.

The rotary body 14 comprises an inner rotating body 14*a* and a rotor 14*b*. The anode target 12, for example, is coupled to the inner rotating body 14*a* by means of a coupling (not shown). The rotor 14*b* is mounted on the outer surface of the inner rotating body 14*a*. A lower end part 15*a* of the fixed shaft 15 in the figure extends out of the vacuum envelope 11. It is used as a holding part that holds the anode unit that comprises the anode target 12 and the rotary support mechanism 13.

A bearing structure is provided at the inner surface of the rotary body 14, or more precisely, a junction between the inner rotating body 14*a* and the outer surface of the fixed shaft 15. In FIG. 1, the bearing structure is shown in part. That is, dynamic sliding bearings Ra and Rb are shown, which are thrusting bearings and have a number of helical grooves, for example.

An insulating cylinder 16 is provided outside the vacuum envelope 11. To the insulating cylinder 16 there is secured a stator coil 17 that generates a rotating magnetic field. The stator coil 17 is connected to a drive-power-supply device 18. The drive-power-supply device 18 comprises, for example, a DC power supply 19 and an inverter 20. It is configured to be controlled by, for example, a control device 21.

The inverter 20 comprises a plurality of switches SW1 to SW6. It receives the direct current supplied from the DC power supply 19 and converts the DC voltage to an AC voltage. The AC voltage is supplied, as drive power, to the stator coil 17.

The control device 21 comprises a switching unit 211, a memory unit 212, a control unit 213 and so on.

The switching unit 211 turns on and off the switches SW1 to SW6 of the inverter 20 at prescribed timings, respectively, thereby converting the direct voltage of the DC power supply 19 to, for example, a three-phase AC voltage. A three-phase AC current is supplied to the coils of the stator coil 17. The voltage applied to the stator coil 17 is adjusted in magnitude in accordance with, for example, the ratio of the on-time of the switches SW1 to SW6 to the off-time thereof.

The memory unit 212 has a plurality of memory regions, for example four memory regions A to D. Each of the memory regions A to D stores a program that controls the drive power supplied from the inverter 20 to the stator coil 17, in accordance with the type of the X-ray tube. For example, four drive conditions a to d, each consisting of frequency and voltage assigned to one type of an X-ray tube.

Drive condition a for supplying drive power to the stator coil provided in an X-ray tube of one type is stored in, for example, the memory region A. Drive condition b for supplying drive power to the stator coil provided in an X-ray tube of another type is stored in, for example, the memory region B. Drive conditions c and d for supplying drive power to the stator coils provided in X-ray tubes of two other types are stored in the memory regions C and D, respectively.

The control unit 213 comprises a dipswitch or the like, which has a plurality of changeover switches. The on-off combination of the changeover switches selects the program, i.e., drive condition, which is stored in one of the memory regions A to D.

In the structure described above, the control unit 213 selects one of the drive conditions, e.g., drive condition a which is stored in the memory region A and which is suitable for driving the stator coil provided in an X-ray tube of one type. The drive condition a is sent to the switching unit 211. The switching unit 211 turns on or off the switches SW1 to SW6 of the inverter 20 in accordance with the drive condition a. The inverter 20 therefore outputs drive power that corresponds to the drive condition a. The drive power is supplied to the stator coil 17. Supplied with the drive power, the stator coil 17 generates a rotating magnetic field. The rotating magnetic field rotates the rotor 14*b* of the rotary body 14. The rotation of the rotor 14*b* is transmitted to the anode target 12. The anode target 12 therefore rotates.

In the structure described above, the memory unit 212 stores a plurality of drive conditions for driving the stator coils provided in X-ray tubes of different types. Hence, by selecting the drive condition fit for the type of the X-ray tube, a drive power fit for the stator coil of an X-ray tube of a specific type can be supplied. The structure can cope with X-ray tubes of various types, unifying drive-power-supply devices in terms of specifications.

In the X-ray apparatus described above, a wrong drive condition which does not match the type of the X-ray tube may be selected, and the X-ray tube may inevitably be driven in a wrong condition. If this is the case, a trouble may develop at the bearing structure of the X-ray tube, or the anode target may rise to an abnormally high temperature. In view of this, it is determined whether the drive condition selected matches the type of the X-ray tube, for example at the time of activating the X-ray apparatus.

Figure 2:
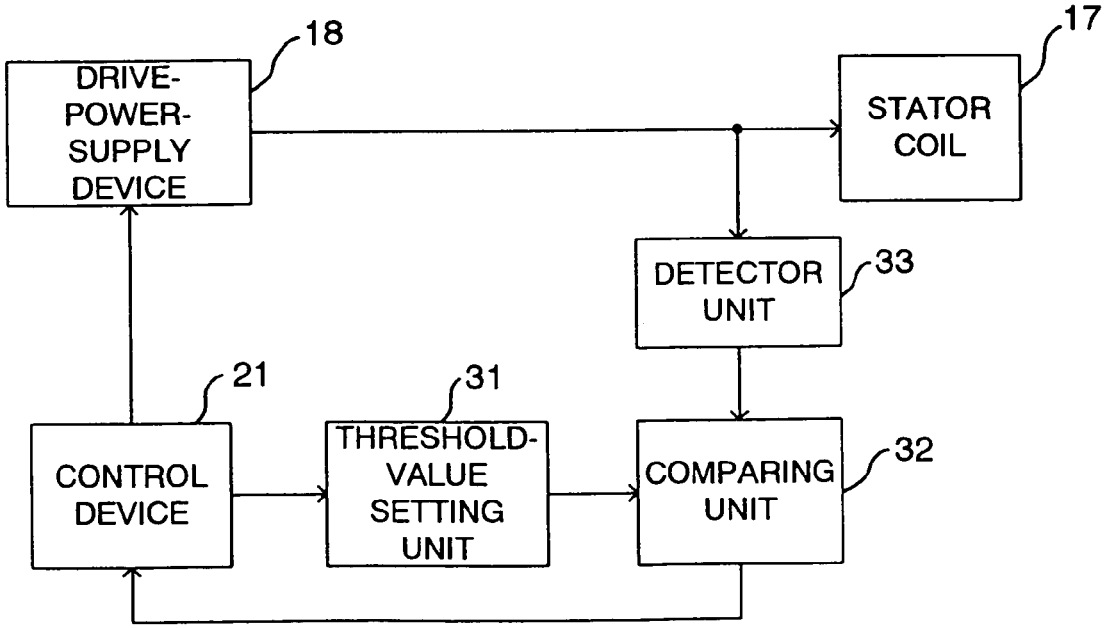
FIG. 2 is a circuit diagram showing the embodiment of the invention and explaining a method of determining whether the X-ray tube is driven in desired conditions.

A method of determining whether the drive condition selected matches the type of the X-ray tube will be explained with reference to FIG. 2. In FIG. 2, the components identical to those shown in FIG. 1 are designated with the same reference numerals. Some of these components will not be described.

First, the power switch provided on the drive-power-supply device 18 is turned on. At this time, the control device 21 selects one drive condition, e.g., condition a that matches the type of the X-ray tube. The drive-power-supply device 18 outputs the drive power corresponding to the drive condition a. The drive power is supplied to the stator coil 17. The control device 21 controls a threshold-value setting unit 31, which generates a threshold value that corresponds to the drive condition a selected. The threshold value is supplied to a comparing unit 32.

The drive-power-supply device 18 outputs a reference voltage of a predetermined value. The reference voltage, e.g., 50V at 50 Hz, is applied to the stator coil 17 for a time ranging from about 5 to 10 seconds.

The reference voltage remains at the same value and the same frequency, no matter which drive condition has been selected. It is such a low voltage as would not damage the bearing structure of any type of an X-ray tube. It is, for example, lower than the voltage applied to the stator coil 17 to pick up a X-ray image of an object, or so low enough not to rotate the rotary part of the anode.

While the reference voltage is being applied, a detector unit 33 detects the current I consumed or the power W consumed flowing through the stator coil 17. In this instance, the detector unit 33 detects the current I. The current I detected is supplied to the comparing unit 32. The comparing unit 32 compares the current I with the threshold value sent from the threshold-value setting unit 31.

Figure 3:
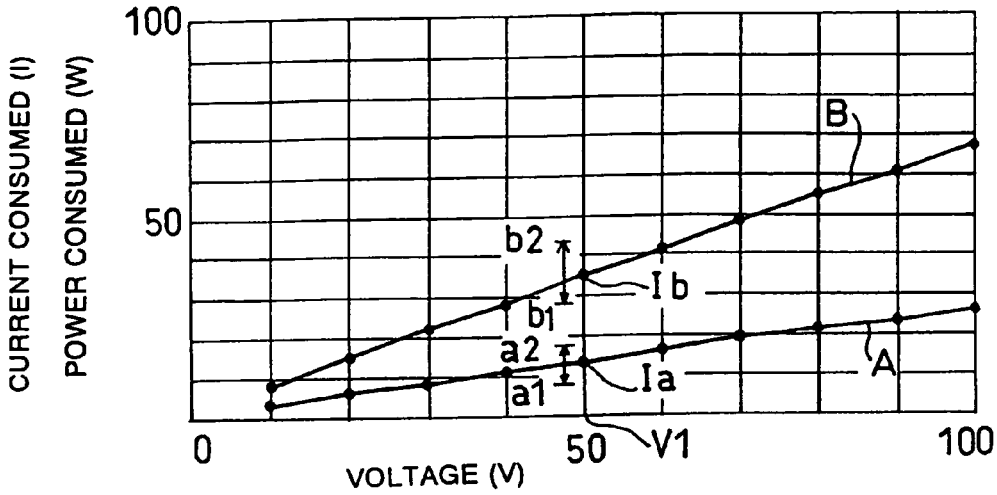
FIG. 3 is a characteristic diagram of the embodiment of the invention, showing the current consumption or power consumption of the X-ray tube.

In this case, the voltage V applied to the stator coil 17 and the current I consumed have such a relation as illustrated in FIG. 3. In FIG. 3, the voltage V applied to the stator coil is plotted on the horizontal axis, and the current I (or power W) is plotted on the vertical axis. Line A and line B represent the current-consumption characteristics (or power-consumption characteristics) of two stator coils of different types.

X-ray tubes of different types have stator coils of different coil-winding specifications, respectively. Hence, if a voltage V of the same frequency and magnitude is applied to the stator coils provided in X-ray tubes, the current I that each stator coil consumes is different, depending on the type of the X-ray tube incorporating the stator coil.

In the case shown in FIG. 3, for example, the stator coil having characteristic A consumes current Ia, whereas the stator coil having characteristic B consumes current Ib, if the reference voltage is V1. If the drive condition a is selected for the stator coil having characteristic A, the threshold value is set within a range of, for example, a1 to a2. If the drive condition b is selected for the stator coil having characteristic B, the threshold value is set within a range of b1 to b2, which is different from the range of characteristic A, i.e., which does not overlap the range for the stator coil of characteristic A.

Here, the drive condition a is selected for the stator coil of characteristic A. Therefore, the current I consumed is compared with a threshold value ranging from a1 to a2. If the consumed current detected falls within the threshold-value range of a1 to a2, it is determined that the stator coil is of the type matching the drive condition selected.

The consumed current detected may not fall within this range. Then, it is determined that the stator coil is not of the type that matches the drive condition selected. The result of this decision is sent to the control device 21. The control device 21 controls the drive-power-supply device 18, which stops supplying the drive power to the stator coil 17.

If the stator coil is determined not to be of the type that matches the drive condition selected, one of other drive conditions b to d is selected. Thus, it is determined whether the stator coil is of the type that matches the new drive condition selected, by the method described above.

As indicated above, the current I consumed at the stator coil is used to determine whether the stator coil matches the drive condition selected. Nevertheless, the power W consumed may be detected and then used to determine whether the stator coil matches the drive condition selected. This is because the power W consumed has the same relation as the current I consumed, with the voltage V applied to the stator coil, as is illustrated in FIG. 3.

The reference voltage used in order to determine if the stator coil matches the drive condition selected remains unchanged in frequency and magnitude, no matter which drive condition has been selected. The use of the same reference voltage makes it easy to determine whether the stator coil matches the drive condition selected. This is because the current- or power-consumption characteristic of a stator coil differs in accordance with the type of the X-ray tube that incorporates the stator coil.

Figure 4:
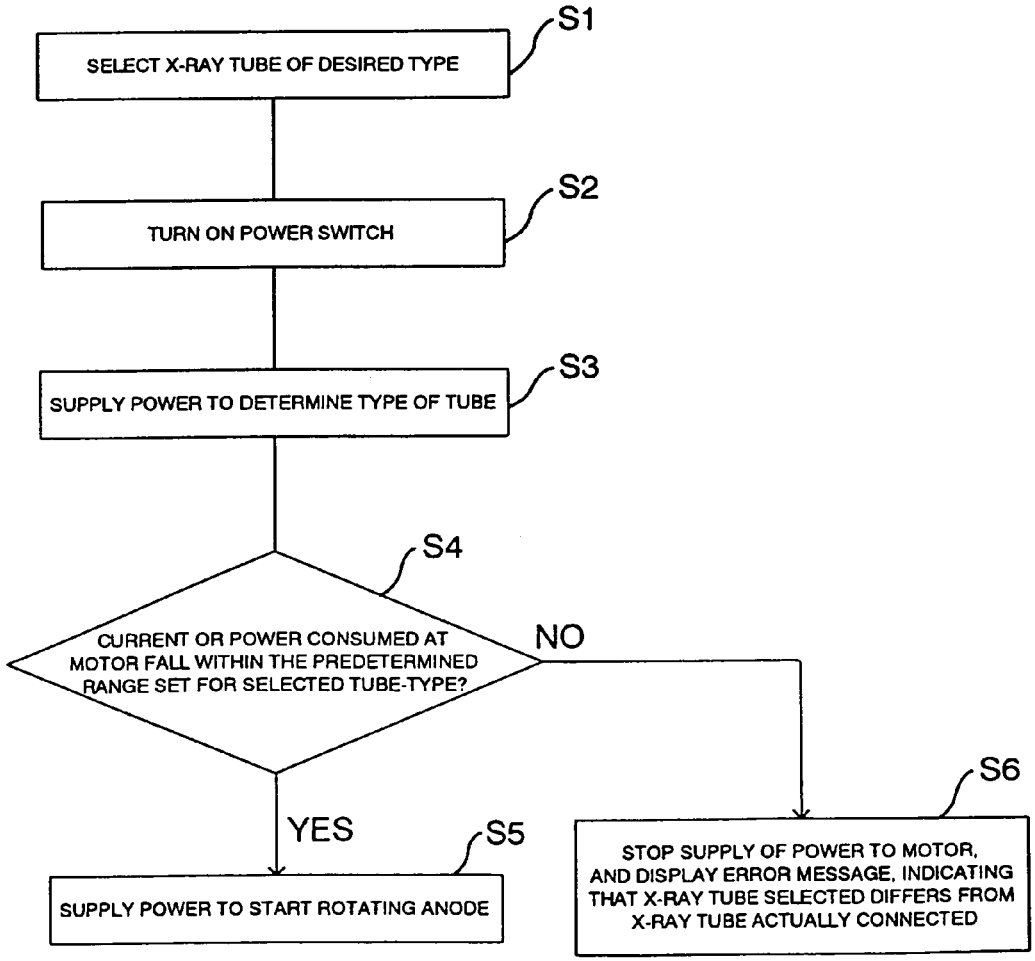
FIG. 4 is a flowchart explaining the embodiment of the invention, showing how it is determined whether the X-ray tube is driven in desired conditions.

The sequence of determining whether the stator coil matches the drive condition selected will be explained with reference to the flowchart of FIG. 4.

First, the control unit 213 is operated, selecting a X-ray tube of the desired type (S1). Then, the power switch is turned on (S2).

Next, the drive-power-supply device 18 supplies a drive power at low level (e.g. V1 shown in FIG. 3) to the stator coil 17 in order to determine whether the stator coil matches the X-ray tube selected (S3).

Then, the current I or power W consumed at the stator coil is detected. It is determined whether the current I or power W falls within the threshold-value range that corresponds to the type of the X-ray tube selected (S4).

It may be determined in Step S4 that the current I or power W falls within the threshold-value range. If this is the case, the drive-power-supply device 18 supplies drive power to the stator coil 17 (S5). This drive power is, for example, at the level for rotating the rotary part of the anode.

In Step S4, it may be determined that the current I or power W does not fall within the threshold-value range. In this case, the drive-power-supply device 18 stops supplying the drive power to the stator coil 17. Also, an error message is displayed, informing that the stator coil does not match the X-ray tube selected (S6).

With configuration described above it is possible to supply the drive power fit for the stator coil of the X-ray tube, irrespective of the type thereof. Hence, drive-power-supply devices can be unified in terms of specifications, and the manufacturing cost can be reduced.

Whether the dive condition selected matches the X-ray tube is determined before the X-ray apparatus starts operating to, for example, photograph an object. Thus, the drive condition would not fail to match the X-ray tube. As a result, the bearing structure of the X-ray tube will not be damaged. Nor will the anode target rise to an abnormally high temperature The present invention can therefore provide an X-ray apparatus in which a drive power fit for the stator coil can be supplied, regardless of the type of the X-ray tube, and a method of driving the X-ray apparatus.

The invention claimed is:

1. An X-ray apparatus having a rotary anode x-ray tube, comprising;

an anode target arranged in a vacuum envelope, a rotary body mechanically coupled to the anode target and configured to rotate together with the anode target, and a fixed shaft supporting the rotary body, allowing the rotary body to rotate on a bearing;

a stator coil generating a rotating magnetic field for rotating the rotary body of the rotary anode X-ray tube;

a drive-power-supply device controlling a drive power to be supplied to the stator coil;

a memory unit storing drive conditions of various types of a plurality of X-ray tubes for controlling the drive power to be supplied to the stator coil; and a control unit supplying a lower level drive power than the drive conditions to an X-ray tube to detect a power consumed in the stator coil and determining whether a selected one of the drive conditions stored in the memory unit and a condition of the detected consumed power match or not.

2. The X-ray apparatus according to claim 1, further comprising:

a detector detecting power or current consumed at the stator coil while a lower level drive power than the drive conditions is applied to the stator coil;

a comparator determining whether the power or current detected at the detector falls within a predetermined range; and a power-supply stopping device stopping supply of power from the drive-power-supply device to the stator coil when the power or current falls outside the predetermined range.

* * * * *